US007704117B2

(12) United States Patent
Jung et al.

(10) Patent No.: US 7,704,117 B2
(45) Date of Patent: Apr. 27, 2010

(54) ELECTRON EMISSION DISPLAY AND METHOD OF FABRICATING MESH ELECTRODE STRUCTURE FOR THE SAME

(75) Inventors: Kyu Won Jung, Anyang (KR); Sang Jin Lee, Suwon (KR); Il Hwan Kim, Seongnam (KR)

(73) Assignee: Samsung SDI Co., Ltd., Suwon-si (KR)

( * ) Notice: Subject to any disclaimer, the term of this patent is extended or adjusted under 35 U.S.C. 154(b) by 723 days.

(21) Appl. No.: 11/251,557

(22) Filed: Oct. 14, 2005

(65) Prior Publication Data

US 2006/0113892 A1 Jun. 1, 2006

(30) Foreign Application Priority Data

Oct. 29, 2004 (KR) ..... 10-2004-0086956

(51) Int. Cl.
*H01J 9/00* (2006.01)

(52) U.S. Cl. ..... 445/49; 445/51

(58) Field of Classification Search ..... 313/497; 445/23, 24, 25, 49–51
See application file for complete search history.

(56) References Cited

U.S. PATENT DOCUMENTS 5,508,584 A 4/1996 Tsai et al.
5,773,927 A 6/1998 Zimlich
6,749,476 B2 * 6/2004 Chang ..... 445/24
6,891,319 B2 5/2005 Dean et al.
2002/0151247 A1 * 10/2002 Yanagisawa ..... 445/50
2002/0175607 A1 * 11/2002 Hofmann et al. ..... 313/309
2004/0113550 A1 * 6/2004 Adachi et al. ..... 313/512
2004/0135493 A1 * 7/2004 Park et al. ..... 313/497

FOREIGN PATENT DOCUMENTS

KR 10-0459906 11/2004

* cited by examiner

*Primary Examiner*—Joseph L Williams
(74) *Attorney, Agent, or Firm*—Christie, Parker & Hale, LLP

(57) ABSTRACT

An electron emission display and method of fabricating a mesh electrode structure for the same. The electron emission display includes: an electron emission substrate having an electron emission region; a mesh electrode structure including a mesh electrode having an opening, through which electrons emitted from the electron emission region can pass, and a mesh electrode insulating layer formed at one side of the mesh electrode using a direct printing method; and an image forming substrate having an image forming region for emitting light by the emitted electrons. The method improves voltage resistance characteristics between the gate or cathode electrode and the mesh electrode, and eliminates the need for a lower spacer.

15 Claims, 4 Drawing Sheets

ELECTRON EMISSION DISPLAY AND METHOD OF FABRICATING MESH ELECTRODE STRUCTURE FOR THE SAME

CROSS-REFERENCE TO RELATED APPLICATIONS

This application claims priority to and the benefit of Korean Patent Application No. 2004-86956, filed Oct. 29, 2004, the disclosure of which is hereby incorporated herein by reference in its entirety.

FIELD OF THE INVENTION

The present invention relates to an electron emission display and method of fabricating the same and, more particularly, to an electron emission display and method of fabricating a mesh electrode structure for the same including a mesh electrode and an insulating layer formed at one side of the mesh electrode on an electron emission substrate.

BACKGROUND

In general, an electron emission device uses a hot cathode or a cold cathode as an electron source. The electron emission device using the cold cathode may employ a field emitter array (FEA) type, a surface conduction emitter (SCE) type, a metal-insulator-metal (MIM) type, a metal-insulator-semiconductor (MIS) type, a ballistic electron surface (BSE) type, and so on.

Using these electron emission devices, an electron emission display, various backlights, an electron beam apparatus for lithography, and the like can be implemented. An electron emission display includes a cathode substrate including an electron emission device to emit electrons, and an anode substrate for allowing the electrons to collide with a fluorescent layer to emit light. Generally, in the electron emission display, the cathode substrate is configured in a matrix shape to which cathode electrodes and gate electrodes intersect each other and includes a plurality of electron emission devices defined in the intersection regions. The anode substrate includes fluorescent layers emitting light by the electrons emitted from the electron emission devices and anode electrodes connected to the fluorescent layers. The electron emission display controls orbits of the emitted electrons to control the corresponding fluorescent layers, and includes mesh electrodes for shielding anode electric fields.

An example of the electron emission display adapting the aforementioned mesh electrode is disclosed in Korean Patent Laid-open Publication No. 2004-57376.

FIG. 1 is a cross-sectional view of an electron emission display including a mesh electrode according to a prior art. Referring to FIG. 1, a cathode plate 10 and an anode plate 20 are spaced apart from each other by a spacer 30. Since the cathode plate 10 and the anode plate 20 are vacuum-sealed, the space between them is in vacuum. Therefore, the cathode plate 10 and the anode plate 20 are securely adhered to each other with the spacer 30 between them by inner negative pressure. In the cathode plate 10, a cathode electrode 12 is formed on a bottom plate 11, and a gate-insulating layer 13 is formed on the cathode electrode 12. A through-hole 13*a* is formed in the gate-insulating layer 13, and the cathode electrode 12 is exposed through the through-hole 13*a*. An electron emission source 14 such as a carbon nanotube (CNT) is formed on the cathode electrode 12 exposed through the through-hole 13*a*. A gate electrode 15 having a gate hole 15*a* (not shown) corresponding to the through-hole 13*a* is formed on the gate-insulating layer 13.

In the anode plate 20, an anode electrode 22 is formed at an inner surface of a top plate 21, a fluorescent layer 23 is formed on a portion of the anode electrode opposite to the gate hole 15*a*, and a black matrix 24 for absorbing and blocking external light and preventing optical crosstalk is formed on the remaining part. A mesh grid 40 is interposed between the cathode plate 10 and the anode plate 20. The mesh grid 40 spaced apart from the anode plate 20 is closely adhered to the cathode plate 10 by the spacer 30. As described above, the space between the cathode plate 10 and the anode plate 20 is in vacuum, therefore, the mesh grid 40 is securely adhered to the cathode plate 10 by the spacer 30. An insulating layer 44 is formed between the mesh grid 40 and the gate electrode 15 of the cathode plate 10. The insulating layer 44 is securely adhered to a surface of the gate electrode 15. The mesh grid 40 has an electron beam control hole 42 corresponding to the gate hole 15*a*.

In the aforementioned electron emission display, the mesh grid made of separate parts from a metal plate is securely adhered to the gate electrode and the spacer presses the mesh grid against the cathode plate.

Because the insulating layer formed at one surface of the mesh grid is etched using the mesh grid as a mask to form an opening corresponding to the electron beam control hole, it requires an etching process that uses a mask, which makes the process complicated and lowers yield.

SUMMARY OF THE INVENTION

The present invention, therefore, solves aforementioned problems associated with conventional displays by providing an electron emission display capable of improving voltage resistance between a cathode electrode and a mesh electrode.

The present invention also provides an electron emission display capable of facilitating large-screen display by forming an insulating layer on the mesh electrode using a direct printing method (entire surface printing method).

In an exemplary embodiment of the present invention, an electron emission display includes: an electron emission substrate having an electron emission region; a mesh electrode structure including a mesh electrode having an opening, through which electrons emitted from the electron emission region pass, and a mesh electrode insulating layer formed at one side of the mesh electrode using a direct printing method; and an image forming substrate having an image forming region for emitting light by the emitted electrons.

In the electron emission display, the mesh electrode insulating layer may include PbO or $SiO_2$.

In another exemplary embodiment of the present invention, a method of fabricating a mesh electrode structure for an electron emission display includes: forming a mesh electrode having an opening for collecting electrons emitted from an electron emission display; and forming a mesh electrode insulating layer by direct printing insulating paste on one side of the mesh electrode.

In the method of fabricating a mesh electrode structure for an electron emission display, the insulating paste may include PbO or $SiO_2$.

BRIEF DESCRIPTION OF THE DRAWINGS

The above and other features of the present invention will be described in reference to certain exemplary embodiments thereof with reference to the attached drawings in which.

DETAILED DESCRIPTION

The present invention will now be described more fully hereinafter with reference to FIGS. 2 to 3E, in which some embodiments of the invention are shown.

Figure 1:
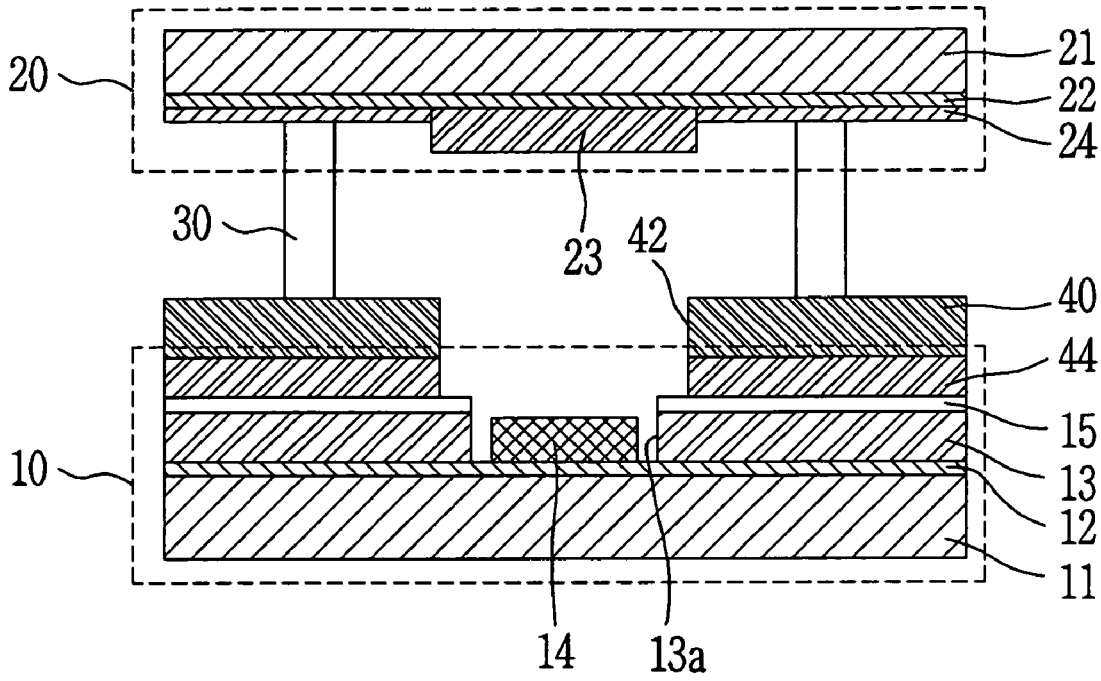
FIG.1 (PRIOR ART)
FIG. 1 is a schematic cross-sectional view of an electron emission display according to a prior art.
Figure 2:
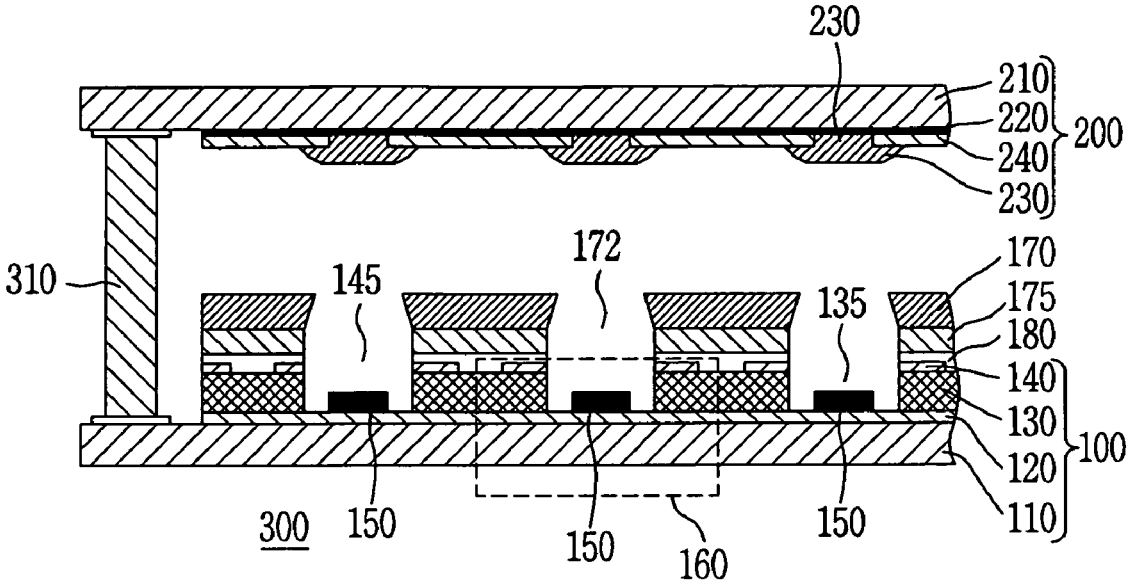
FIG. 2 is a cross-sectional view of an electron emission display in accordance with an embodiment of the present invention.

FIG. 2 is a cross-sectional view of an electron emission display in accordance with an embodiment of the present invention. Referring to FIG. 2, the electron emission display 300 includes: an electron emission substrate 100 having an electron emission region; a mesh electrode structure including a mesh electrode 170 having an opening 172, through which electrons emitted from the electron emission region can pass. The electron emission display 300 also includes a mesh electrode insulating layer 175 formed at one side of the mesh electrode 170 using a direct printing method and an image forming substrate 200 having an image forming region for emitting light by the emitted electrons.

The electron emission substrate 100 includes at least one electron emission display 160 having a first electrode 120, a second electrode 140 insulated from the first electrode 120 and intersecting the first electrode 120, and an electron emission part 150 connected to the first electrode 120. The mesh electrode 170 collects electrons emitted from the electron emission device 160. A mesh electrode insulating layer 175 is formed at one side of the mesh electrode 170 using a direct printing method. The image forming substrate 200 includes a fluorescent layer 230 for emitting light by the emitted electrons and an anode electrode 220 connected to the fluorescent layer 230, wherein the mesh electrode insulating layer 175 is formed on the electron emission substrate 100.

At least one cathode electrode 120 is disposed on the substrate 110 in a predetermined shape, for example, a stripe shape. The substrate is typically formed of a glass or silicon substrate, preferably, a transparent substrate such as a glass substrate, when the electron emission part 150 is formed by a rear surface exposure method using carbon nanotube (CNT) paste.

The cathode electrode 120 supplies each data signal from a data driver (not shown), or each scan signal from a scan driver (not shown) to each pixel. In this process, the pixel is defined as a region where the cathode electrode 120 and the gate electrode 140 overlap each other. The cathode electrode 120 is made of indium tin oxide (ITO) to transmit light emitted from the fluorescent layers 230 to the exterior.

The insulating layer 130 is formed on the substrate 110 and the cathode electrode 120, and electrically insulates the cathode electrode 120 from the gate electrode 140. The insulating layer 130 is made of an insulating material such as composite glass of PbO and $SiO_2$, and includes at least one first opening 135 at the overlap region of the cathode electrode 120 and the gate electrode 140 exposing the cathode electrode 120.

The gate electrode 140 is disposed on the insulating layer 130 in a predetermined shape, for example, a stripe shape in the direction overlapping the cathode electrode 120, and supplies each data signal or scan signal supplied from the data driving part or the scan driving part to each pixel. The gate electrode 140 is made of at least one conductive metal material selected from Au, Ag, Pt, Al, Cr and alloys thereof, and includes at least one hole 145 for exposing the cathode electrode 120.

The mesh electrode 170 includes at least one second opening 172, through which the electrons emitted from the electron emission part 150 pass, to collect the electrons into the corresponding fluorescent layer 230. In addition, the mesh electrode 170 prevents the electrodes from being damaged, when arc discharge is generated, thereby protecting the cathode electrode 120, the gate electrode 140 and the electron emission part 150 from an anode electric field formed by the high voltage applied to the anode electrode 220. That is, the mesh electrode 170 collects the electrons emitted from the electron emission region into the corresponding image forming region, and protects the electron emission substrate 100 from the anode electric field formed by the high voltage applied to the image forming substrate 200.

In one embodiment, the mesh electrode insulating layer 175 includes PbO or $SiO_2$ and is formed at one side of the mesh electrode 170 in order to improve voltage resistance characteristics between the cathode electrode 120, the gate electrode 140 and the mesh electrode 170.

The mesh electrode 170 and the mesh electrode insulating layer 175 are formed by a process different from the process of forming the electron emission substrate 100. Then, the mesh electrode insulating layer 175 is formed on the gate electrode 140, which may be adhered by glass frit 180, but not limited thereto.

The image forming substrate 200 includes a top substrate 210, an anode electrode 220 formed on the top substrate 210, fluorescent layers 230 connected on the anode electrode 220 and emitting light by electrons emitted from the electron emission device 160, and light-shielding layers 240 formed between the fluorescent layers 230.

The fluorescent layers 230 emitting light by a collision of the electrons emitted from the electron emission part 150 are selectively disposed on the top substrate 210, and are spaced apart from each other by an arbitrary interval.

The anode electrode 220 accelerates the electrons emitted from the electron emission part 150, when a high positive voltage is applied to the anode electrode 220 to accelerate the electrons toward the fluorescent layers 230.

The top substrate 210 and the anode electrode 220 are preferably made of transparent materials, for example, the top substrate 210 is made of glass, and the anode electrode is made of ITO, to transmit light emitted from the fluorescent layers 230 to the exterior.

The light-shielding layers 240 spaced apart from each other by an arbitrary interval are disposed between the fluorescent layers 230 in order to improve brightness by absorbing and blocking external light and preventing optical crosstalk.

The image forming substrate 200 may further include a metal reflective layer (not shown) functioning to improve reflection efficiency by more favorably collecting the electrons emitted from the electron emission part 150 and reflecting the light emitted by the collision of the electrons, on the fluorescent layers 230.

The fluorescent layers 230 and the light-shielding layers 240 are formed to be connected on the anode electrode 220, and the high voltage for accelerating the electrons therethrough is applied to the image forming substrate 200. When the metal reflective layer functions as an anode electrode, the anode electrode 220 may be an optional and unnecessary component.

In the electron emission display 300 employing the mesh electrode 170 and the mesh electrode insulating layer 175, a positive voltage is applied to the cathode electrode 120 from the exterior, a negative voltage is applied to the gate electrode 140, and a positive voltage is applied to the anode electrode 220. As a result, an electric field is formed around the electron emission part 150 due to a voltage difference between the cathode electrode 120 and the gate electrode 140 to emit the electrons. The emitted electrons are collected by the fluorescent layer 230 corresponding to the mesh electrode 170. The electrons are then induced by the high voltage applied to the anode electrode to collide with the corresponding fluorescent layer 230, thereby emitting the light to realize a predetermined image.

The electron emission display 300 employing the mesh electrode 170 and the mesh electrode insulating layer 175 is capable of improving voltage resistance characteristics between the mesh electrode and the gate electrode or the cathode electrode, and substituting for a lower spacer supporting and spacing the electron emission substrate 100 and the image forming substrate 200. Therefore, since a complex process requiring loading and disposition of the spacer can be substituted, the cathode process can perform the aforementioned processes as a whole.

FIGS. 3A to 3E are cross-sectional views illustrating processes of fabricating the electron emission display in FIG. 2. As shown, a method of fabricating a mesh electrode structure for electron emission display includes forming a mesh electrode 170 including an opening 172 for collecting electrons emitted from an electron emission device 160, and forming a mesh electrode insulating layer 175 by direct printing insulating paste at one side of the mesh electrode 170. A screen printing method uses a printing plate having a predetermined mask pattern to form a predetermined pattern layer, but a direct printing method forms a layer having a predetermined thickness on a non-opening portion without a predetermined mask. Even though the direct printing method is used, a pattern may be formed by a printing plate on an area excluding an active area (i.e., an area formed with an opening).

Through the direct printing method, a printing plate such as P0350 or P0380 with low injection capacity may be used. Also, it is possible to print only on a desired non-opening region without blocking the opening of the structure having a predetermined opening such as the mesh electrode 170.

Figure 3A:
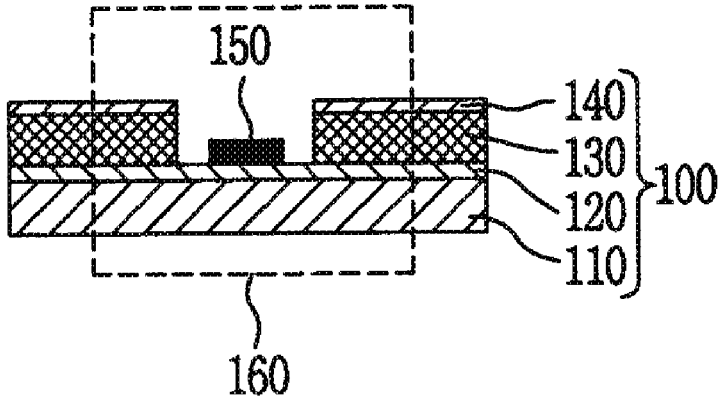
FIGS. 3A to 3E are cross-sectional views illustrating processes of fabricating the electron emission display of FIG. 2.

In the foregoing embodiments, "forming the mesh electrode insulating layer 175" means that printing is directly performed without selectively forming the pattern on the active area where the opening exit with a mask pattern. In this case, it is preferable that an insulating paste does not block up the opening. Further, the direct printing method can be performed in various directions. Also, printing and drying are performed several times and then annealing is performed, so that the formed layer can have a preferred thickness. Through these processes, the formed layer can be planarized. As compared with the screen printing method, the direct printing method allows the fabrication process to be simplified, and thus the mass-production to be reliable. As shown in FIG. 3A, An electron emission substrate 100 including at least one electron emission device 160 is formed. The electron emission device 160 includes a cathode electrode 120 formed on a bottom substrate 110, a gate electrode 140 formed to intersect the cathode electrode 120, an insulating layer 130 insulating the cathode electrode 120 from the gate electrode 140, and an electron emission part 150 connected to the cathode electrode 120 in a hole formed at a region, at which the cathode electrode 120 and the gate electrode 140 intersect each other. In this process, while the embodiment illustrates the electron emission device having an upper gate structure, all structures that emit electrons may be adapted thereto, without any limitation.

Figure 3B:
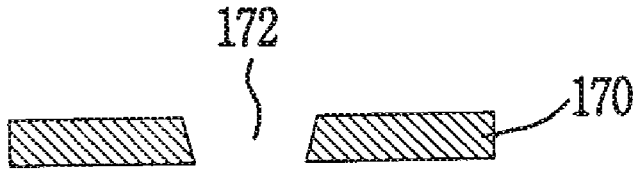
Figure 3C:
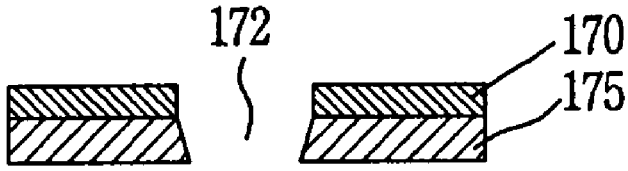
Figure 3D:
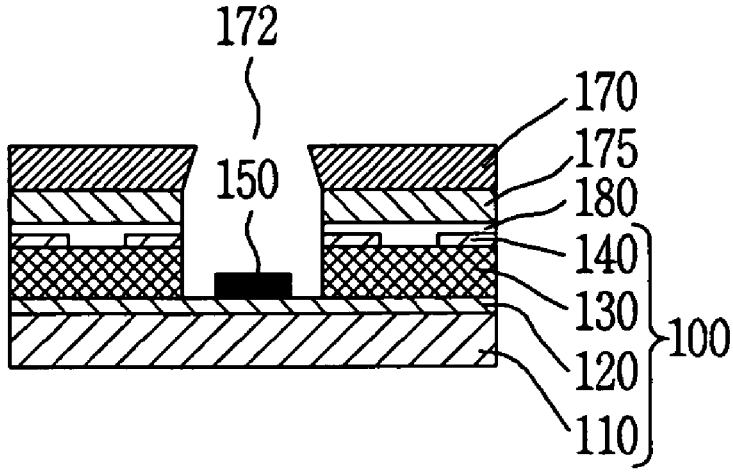
Figure 3E:
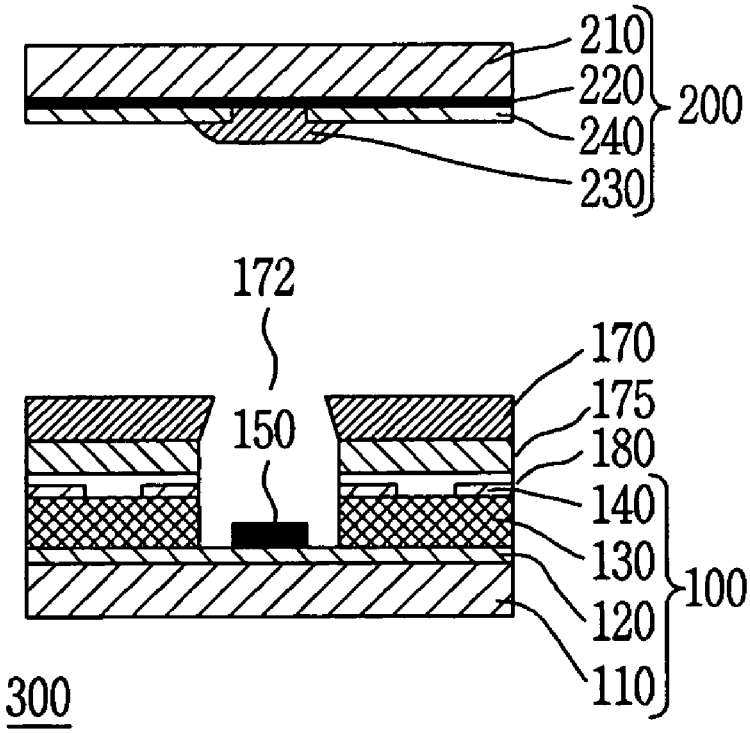

Next, a mesh electrode 170 including at least one second opening 172, through which the electrons emitted from the electron emission device 160 pass, is formed, as shown in FIG. 3B.

Next, a mesh electrode insulating layer 175 is formed on the mesh electrode 170 by a direct printing method using insulating paste including PbO or $SiO_2$. This process is different from the prior art, in which the opening of the insulating layer corresponding to the electron control hole of the mesh grid is formed by etching the insulating layer using the mesh grid as a mask. The present invention is capable of readily forming the mesh electrode insulating layer 175 by a coating process using a direct insulating plate, without blocking the holes or using an etching process. Then, the mesh electrode insulating layer 175 is formed on the electron emission substrate 100 to be adhered thereto, for example, by using glass frit 180, but not limited thereto.

Next, the mesh electrode insulating layer 175 is adhered on the electron emission substrate 100 using the glass frit 180. Then, an image forming substrate 200 including a top substrate 210, an anode electrode 220 formed on the top substrate 210, a fluorescent layer 230 connected to the anode electrode 220, and a light-shielding layer 240 formed between the fluorescent layers 230 is formed. In this process, the constitution of the image forming substrate is exemplary, but not limited thereto. Various constitutions capable of forming a predetermined image by the collision of electrons are applicable to the present invention.

Next, a process of sealing the electron emission substrate 100 and the image forming substrate 200 using a sealant (not shown) is performed to complete the electron emission display.

As described above, the process yield of the electron emission display can be improved by omitting a separate lower spacer loading process. Also, it is possible to prevent the substrate from being damaged due to twisting.

As can be seen from the foregoing, the electron emission display of the present invention is capable of improving voltage resistance characteristics between the gate or cathode electrode and the mesh electrode, and readily adapting to a large screen flat panel display by suppressing deformation of the mesh electrode.

In addition, a method of fabricating a mesh electrode for an electron emission display in accordance with an embodiment of the present invention is capable of suppressing damage of the substrate by substituting the mesh electrode for the lower spacer during a package process of the electron emission substrate and the image forming substrate, and improving the process yield of the electron emission display by omitting a separate spacer loading process.

Although the present invention has been described with reference to certain exemplary embodiments thereof, it will be understood by those skilled in the art that a variety of modifications and variations may be made to the present invention without departing from the spirit or scope of the present invention defined in the appended claims, and their equivalents.

What is claimed is:

1. A method of fabricating a mesh electrode structure for an electron emission display, the method comprising:

forming a mesh electrode having an opening for collecting electrons emitted from the electron emission display; and forming a mesh electrode insulating layer by direct printing insulating paste on a portion of the mesh electrode excluding said opening, on one side of the mesh electrode, wherein after the insulating layer is formed on the portion of the mesh electrode excluding said opening, the mesh electrode structure includes an opening substantially equal to said opening, without an etching process.

2. The method according to claim 1, wherein the insulating paste includes one of the group consisting of PbO and $SiO_2$.

3. The method according to claim 1, further comprising adhering the mesh electrode insulating layer on a first substrate using a glass frit.

4. The method according to claim 1, wherein the mesh electrode is formed on a first substrate and the method further comprising forming an image forming substrate to be sealed with the first substrate.

5. The method according to claim 4, further comprising sealing the image forming substrate and the first substrate together.

6. The method according to claim 4, wherein the image forming substrate includes a top substrate, an anode electrode formed on the top substrate, a fluorescent layer connected to the anode electrode, and a light-shielding layer formed between the fluorescent layers.

7. A method of fabricating a mesh electrode structure for an electron emission display, the method comprising:

forming a mesh electrode on a substrate, the mesh electrode having an opening for collecting electrons emitted from the electron emission display; and forming a mesh electrode insulating layer on one side of the mesh electrode having said opening by a coating process, without blocking the opening, after said mesh electrode is formed on the substrate, wherein after the insulating layer is formed on the mesh electrode, the mesh electrode structure includes an opening substantially equal to said opening.

8. The method according to claim 7, wherein the coating process is a direct printing process.

9. The method according to claim 8, wherein the direct printing process utilizes an insulating paste.

10. The method according to claim 9, wherein the insulating paste includes one of the group consisting of PbO and $SiO_2$.

11. The method according to claim 7, further comprising adhering the mesh electrode insulating layer on a substrate using a glass frit.

12. The method according to claim 7, further comprising forming an image forming substrate to be sealed with the substrate.

13. The method according to claim 12, further comprising sealing the image forming substrate and the substrate together.

14. The method according to claim 12, wherein the image forming substrate includes a top substrate, an anode electrode formed on the top substrate, a fluorescent layer connected to the anode electrode, and a light-shielding layer formed between the fluorescent layers.

15. A method of fabricating a mesh electrode structure for an electron emission display, the method comprising:

forming a mesh electrode having an opening for collecting electrons emitted from the electron emission display; and forming a mesh electrode insulating layer having a thickness on a non-opening portion of one side of the mesh electrode, wherein the mesh electrode structure is formed without a predetermined mask.

* * * * *